US005082248A

United States Patent [19]

Harig

[11] Patent Number: 5,082,248

[45] Date of Patent: Jan. 21, 1992

[54] APPARATUS FOR PULLING ON A LINE

[75] Inventor: Manfred Harig, Bergisch Gladbach, Fed. Rep. of Germany

[73] Assignee: Greifzug Hebezeugbau GmbH, Bergisch Gladbach, Fed. Rep. of Germany

[21] Appl. No.: 408,114

[22] Filed: Sep. 15, 1989

[30] Foreign Application Priority Data

Sep. 23, 1988 [DE] Fed. Rep. of Germany ..... 3832360

[51] Int. Cl.[5] ..... B66D 1/00

[52] U.S. Cl. ..... 254/333; 254/265; 226/171

[58] Field of Search ..... 254/333, 365, 265; 226/171, 172

[56] References Cited

U.S. PATENT DOCUMENTS

| | | | |
|---|---|---|---|
| 1,716,229 | 6/1929 | Immel | 254/265 |
| 1,759,105 | 5/1930 | Evans | 242/171 X |
| 2,875,890 | 3/1959 | Good | 254/265 X |
| 2,938,707 | 5/1960 | Allenbaugh | 254/333 X |
| 3,729,173 | 4/1973 | Levardon | 254/333 |
| 4,139,178 | 2/1979 | Hippach | 254/333 X |

FOREIGN PATENT DOCUMENTS

| | | | |
|---|---|---|---|
| 278996 | 7/1965 | Australia | 254/333 |
| 827486 | 9/1975 | Belgium . | |
| 2201548 | 7/1973 | Fed. Rep. of Germany . | |

*Primary Examiner*—Katherine Matecki
*Attorney, Agent, or Firm*—Body, Vickers & Daniels

[57] ABSTRACT

Apparatus is described for pulling on a line, such as a wire cable. The apparatus has a driving pulley with a circumferential groove in which a loop of the load run of the line is held. A pressure application unit is provided to press the line into the line groove towards the end of the loop. This unit has a guide piece around which a chain runs, with a running surface shaped to run parallel to the line groove which it opposes. Means are provided to press the guide unit and chain bodily onto the edge of the driving pulley, so that pressure elements spread along the chain press on the line loop. The pressure elements roll on rollers along the guide unit running surface, which is at least as long as two pressure elements so as to provide an even force on the line.

16 Claims, 3 Drawing Sheets

FIG.3
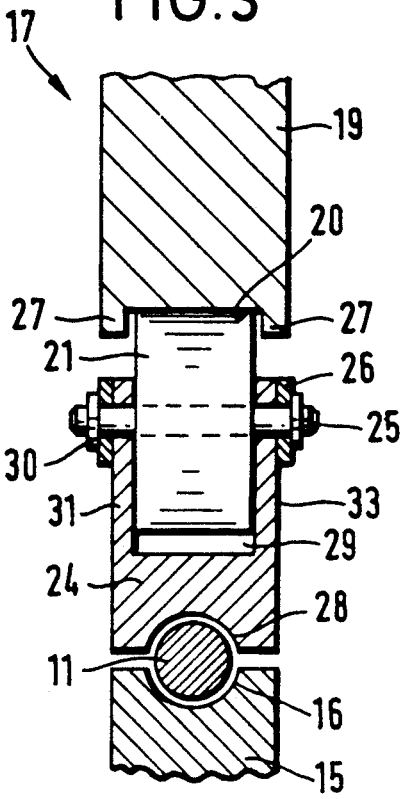
FIG.4
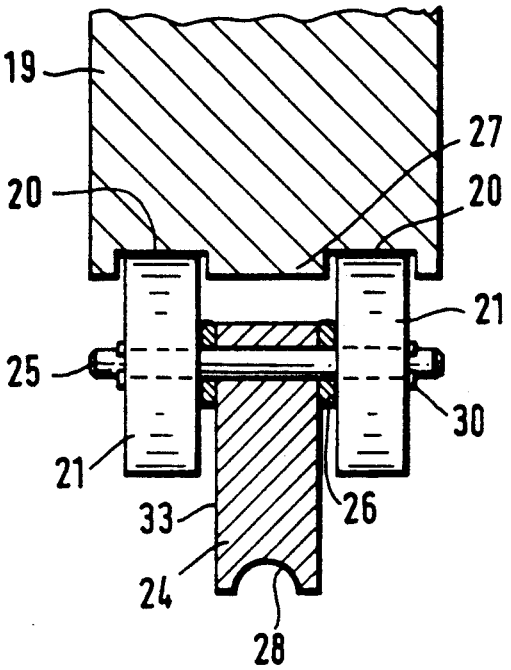
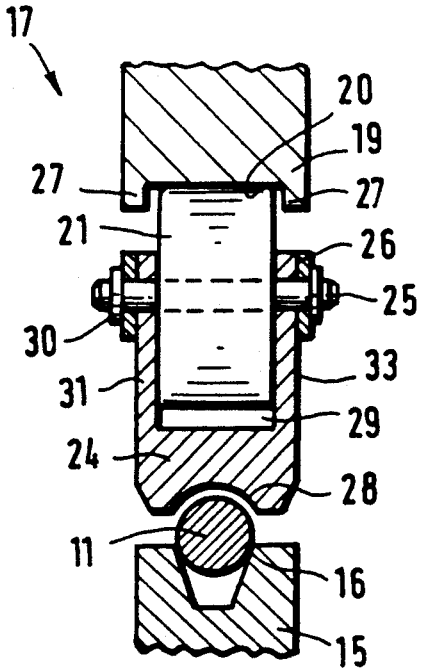
FIG.5

APPARATUS FOR PULLING ON A LINE

FIELD OF THE INVENTION

This invention relates to apparatus for pulling on a line, e.g. a rope, cable or belt, by a driven pulley about which a loop of the load run of the line is placed.

BACKGROUND OF THE INVENTION

It is known in such apparatus, or tackle, to provide means for pressing the loop of line onto the pulley to ensure that effective drive takes place without slipping of the line.

One such system is shown in DE-A-22 01 548 (TRACTEL S.A.). A guide track carrying an endless chain is fixed into the system housing near to the edge of the drive pulley. Three rollers mounted on a rocking beam are positioned inside a concave curve of the chain loop and can be moved to press the chain against the neighbouring part of the loop of line on the pulley. The rollers roll against convex inner rolling surfaces of the chain links. To ensure that the chain runs without slipping, its linking pins have end rollers which seat in circumferentially spaced notches of a drive pulley flange when pressed thereagainst, and roll on the chain track when away from the pulley.

In this system there is a good deal of rattling noise, since pressing the concave chain portion against the line shortens the chain path and hence slackens the chain around the track.

Another known system is seen in Belgian Patent 827 486. Here three pressure rollers, mounted in a housing which can be moved radially, are urgeable against the pulley periphery to engage the line directly. The possibility of having a chain loop running round the rollers is also mentioned.

In such a system with a chain, each chain link would undergo a tilting movement as it passed underneath a roller. So, instead of a uniform application of pressure there would be highly localised, non-uniform "line contacts" which could damage the line.

SUMMARY OF THE INVENTION

One object of the invention is to provide apparatus for pulling on a line, of the type described, wherein high pressure can be applied to the line loop on the drive pulley with less tendency to deform and damage it.

A preferred optional object is to provide apparatus of the type described wherein noise caused by a chain of the apparatus is reduced in operation.

Accordingly, the invention provides apparatus for pulling on a line, comprising:

(a) a drive pulley drivable in rotation, the drive pulley having a line groove extending around it for seating a loop of line to be pulled;

(b) a pressure application unit mounted adjacent the drive pulley, comprising (i) a guide unit disposed radially outwardly of the line groove of the drive pulley, with a running surface of said guide unit facing the line groove and extending in a curve substantially parallel thereto;

(ii) an endless chain, mounted to run around the guide unit and along said running surface thereof, said chain comprising along its length a plurality of pressure elements and a plurality of rotatable pressure rollers, said pressure elements rolling on said pressure rollers on said running surface and having outer parts adapted to engage line seated in the line groove of the drive pulley;

(c) means for urging the guide unit radially inwardly towards the line groove for pressure engagement of line seated therein by said outer part of at least one said pressure element on the running surface of the guide unit.

In this arrangement, the provision of a running surface on the movable guide unit, running parallel to the bottom of the line groove and on which the pressure elements roll through rollers, means that the pressure elements do not undergo rocking movements when pressure is applied to them. Generally pressure is not applied to the line until the pressure element is substantially in aligned contact therewith. Because the pressure application surface remains constant, the permissible pressure on the outer part of the line e.g. cable strands, is not exceeded even under high load. So that there is always optimum contact between pressure element and rope even where the course of the rope is not uniform, it is preferred that the pressure application unit is mounted to be tiltable, e.g. by a pivot mounting of the guide unit on the urging means.

To allow using the largest possible pressure application surface area it is advantageous if the pressure elements are arranged in every second chain link. This also reduces the tendency for the pressure elements to influence each other, so that their pressure application behaviour is determined substantially exclusively by the course of the path of travel of the pressure application unit.

To transmit the pressure application force in optimum manner from the pressure application guide unit to the pressure elements, each pressure element preferably has at least two pressure rollers arranged spaced from one another in the longitudinal direction of the chain. To keep the overall height of the pressure application unit small, it is preferred that the pressure rollers overlap the pressure elements radially. For example it is possible to arrange the pressure rollers in the longitudinal central plane of the pressure elements, or, in the event of especially high pressure application forces, or if the width of the pressure elements is small e.g. because of the line shape, it is possible to arrange pressure rollers at each side of the pressure elements. For some particular applications it may be advantageous to combine various pressure roller arrangements.

So that the chain is given lateral guidance when operating, and cannot slip off the pressure application unit even when the rope is not introduced, it has been found sensible to delimit the running surface of the pressure application unit at both sides by guide flanges. This also substantially facilitates the assembling of the system.

A preferred construction for the pressure rollers is as rolling contact bearings with a reinforced outer ring or race; this ensures that high radial pressure application forces are reliably transmitted to the pressure elements. Closed bearings may be fitted to protect the rolling elements from the entry of abraded material and dust.

It is particularly preferred for at least two pressure elements always to press the line at the same time into the line groove. So, it is advantageous if the length of that running surface of the pressure application unit which is parallel to the bottom of the line groove of the pulley is at least as large as the distance occupied by two successive pressure elements in the chain. The longer the parallel part of the running surface is, the more pressure elements can transmit the pressure application force, and the smaller the pressure per unit of surface area transmitted to the outer parts of the line.

The chain may be constructed with successive pressure elements connected together by flat chain links which are mounted e.g. on the same pins as the pressure rollers.

Further features, advantages and explanation of the invention are given in the following description and drawings.

BRIEF DESCRIPTION OF THE DRAWINGS

In the drawings:

FIG. 3 shows the subject of FIG. 2 on a larger scale in a partial cross-section taken on the line III—III, showing the profile of a pressure element and line groove;

FIG. 4 shows a pressure element of the chain with an alternative arrangement of the pressure rollers, in a view corresponding to FIG. 3, and FIG. 5 shows another constructional form of pressure element and line groove in a similar partial cross-section taken on the line III—III of FIG. 2.

DETAILED DESCRIPTION OF THE PREFERRED EMBODIMENTS

Figure 1:
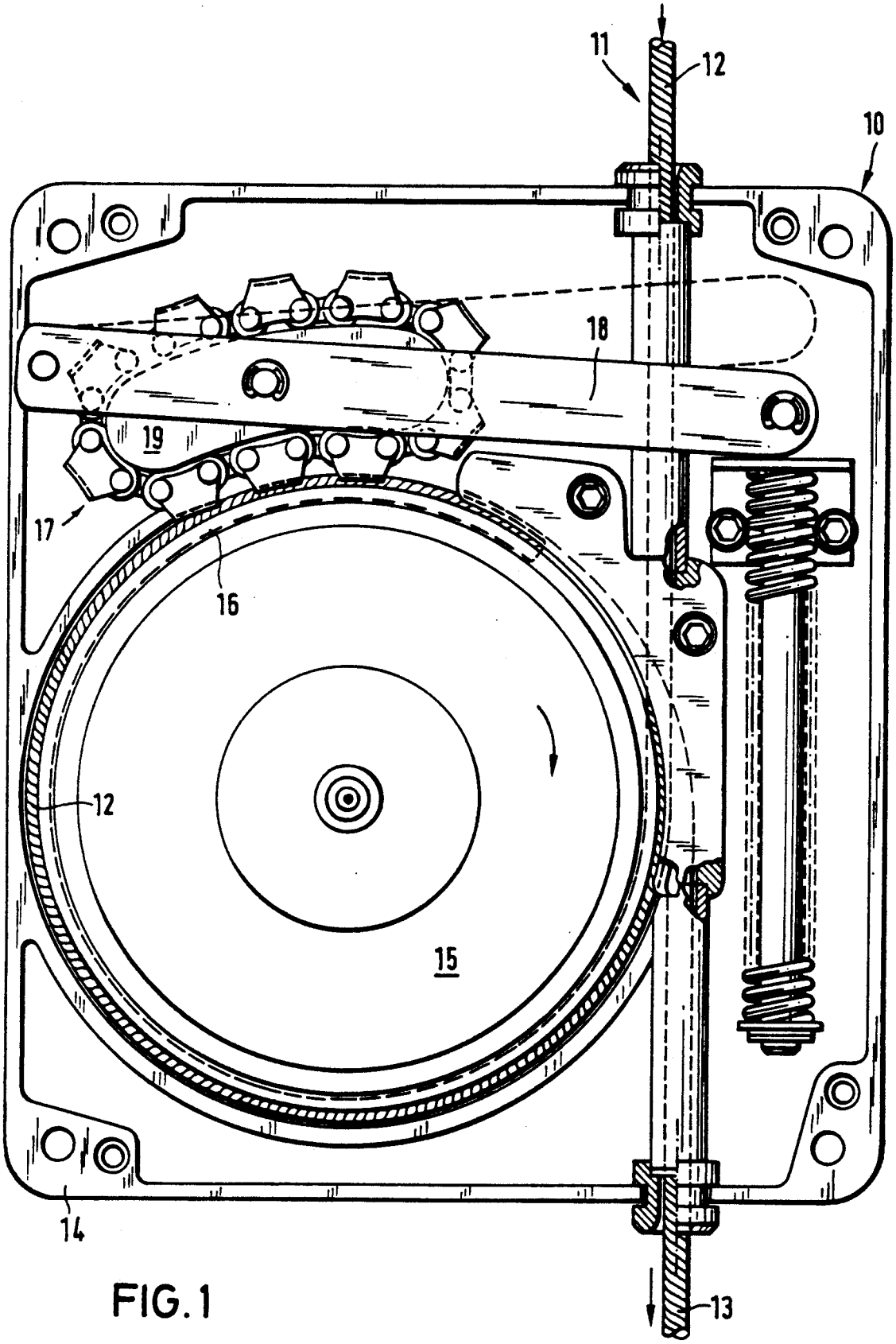
FIG. 1 is a side view of a cable pulling or tensioning system embodying the invention, with a housing cover removed, some parts being shown in fragmentary manner for the sake of greater clarity.

FIG. 1 is a general view of a device or apparatus for hauling on or tensioning a line 11. The line 11 is a through-running line with a load run 12 on which a load which is to be moved is applied. The apparatus comprises an outer housing 14 in which a drive pulley 15 is mounted rotatably. A circumferential line groove 16 extends around the drive pulley edge. The load run 12 of the line 11 (which might be, for example, a steel cable) runs tangentially into the line groove 16, is looped about the pulley 15, and then is led tangentially off the pulley 15 and out of the housing 14 as slack run 13, in the direction opposite to the load run 12. The nature of the apparatus provided for driving the drive pulley 15 in rotation is not part of the subject of this invention and therefore has not been shown.

The line groove 16 of the pulley 15 may take various forms. As shown in FIG. 3 it may have a semi-circular cross-section suited to the size of line 11 to be used. An alternative form is shown in FIG. 5, where the pulley 15 has a partially wedge-shaped or inwardly tapering flat-sided groove 16 to cause additional compression of the line 11 and hence greater grip.

A spring-loaded lever 18 is mounted in the housing 14 with a pivot at its left-hand end as seen in FIG. 1. Its other end is acted on by a spring-loaded device for urging its central part radially towards the axis of the drive pulley 15. The lever 18 forms part of means for applying pressure to line looped around the pulley 15 at the end of the looped length, i.e. towards the take-off of the slack run. These means include in particular a pressure application unit 17 mounted tiltably on the lever 18 by means of a pivot near to the edge of the pulley 15. The pressure application unit 17 consists of a pressure application guide unit 19 of a kidney-like shape around which runs a articulated chain 22, in substantially the same plane as the drive pulley. The chain 22 is carried entirely by the guide unit 19 and moves bodily with it on movement of the lever 18. A continuous chain track extends right around the guide unit 19 and the chain 22 is a substantially close fit on this. The chain 22 comprises a number of links articulated together pivotably by transverse pins 25, one at each end of each link. Each alternate link is a pressure element 24. The links in between the pressure elements are flat links 26 which are provided in pairs and are outside the pressure elements 24 at the pinned joints—see FIG. 3. Journaled on the pins 25, i.e. at the end of each link, are pressure rollers 21 which roll on the chain track around the guide unit 19.

An important feature of the guide unit 19 is a running surface 20 which faces onto the nearby periphery of the drive pulley 15. This running surface 20, on which the chain rollers 21 run, has a length L extending parallel to the line groove 16 of the drive pulley 15. That is, in the version shown the running surface 20 is a substantially cylindrical surface concentric with the pulley 15. As can be seen in FIG. 3, the running surface is bounded at each side by a guide flange 27 to prevent the pressure rollers 21 from slipping sideways off it.

The pressure elements 24 have outer parts, that is, those parts facing onto the line 11 when those pressure elements are running on the running surface 20, adapted to engage the line 11. In the version shown these outer parts have a profile 28 with a part-circular section longitudinal channel to engage with and conform to the outer curve of the line 11. This has the advantage that applied pressure forces are distributed more uniformly over the line 11 and hence wear of the line is reduced. With reference to FIG. 3, the pressure elements 24 in a first embodiment are seen to have deep longitudinal grooves or channels 29 on their inner sides. The walls of these channels 29 have transverse bores at their front and rear ends which serve to take the pins 25 joining the links together. These pins 25 have the additional function of forming the axles of the pressure rollers 21. The pressure rollers 21 are housed and recessed inside the channels 29, with their central planes coinciding with the central longitudinal planes of the pressure elements 24. This recessing provides a substantial radial overlap of rollers 21 and pressure elements 24 which reduces the overall radial extent of the pressure application unit 17. The flat links 26 forming the links alternating with the pressure elements 24 pass to the outside of the flanges or walls 31 of the grooves 29 of the pressure elements 24, and are secured there over the ends of the pins 25 by spring rings 30. Rivet-type heads might be used in place of spring rings.

The pressure rollers 21 used are constructed as rolling contact bearings with a reinforced outer ring or race, so as to be able to transmit even considerable pressure effectively and smoothly without excessive rolling friction. The bearings used are closed, to guard against the harmful entry of foreign matter.

Figure 2:
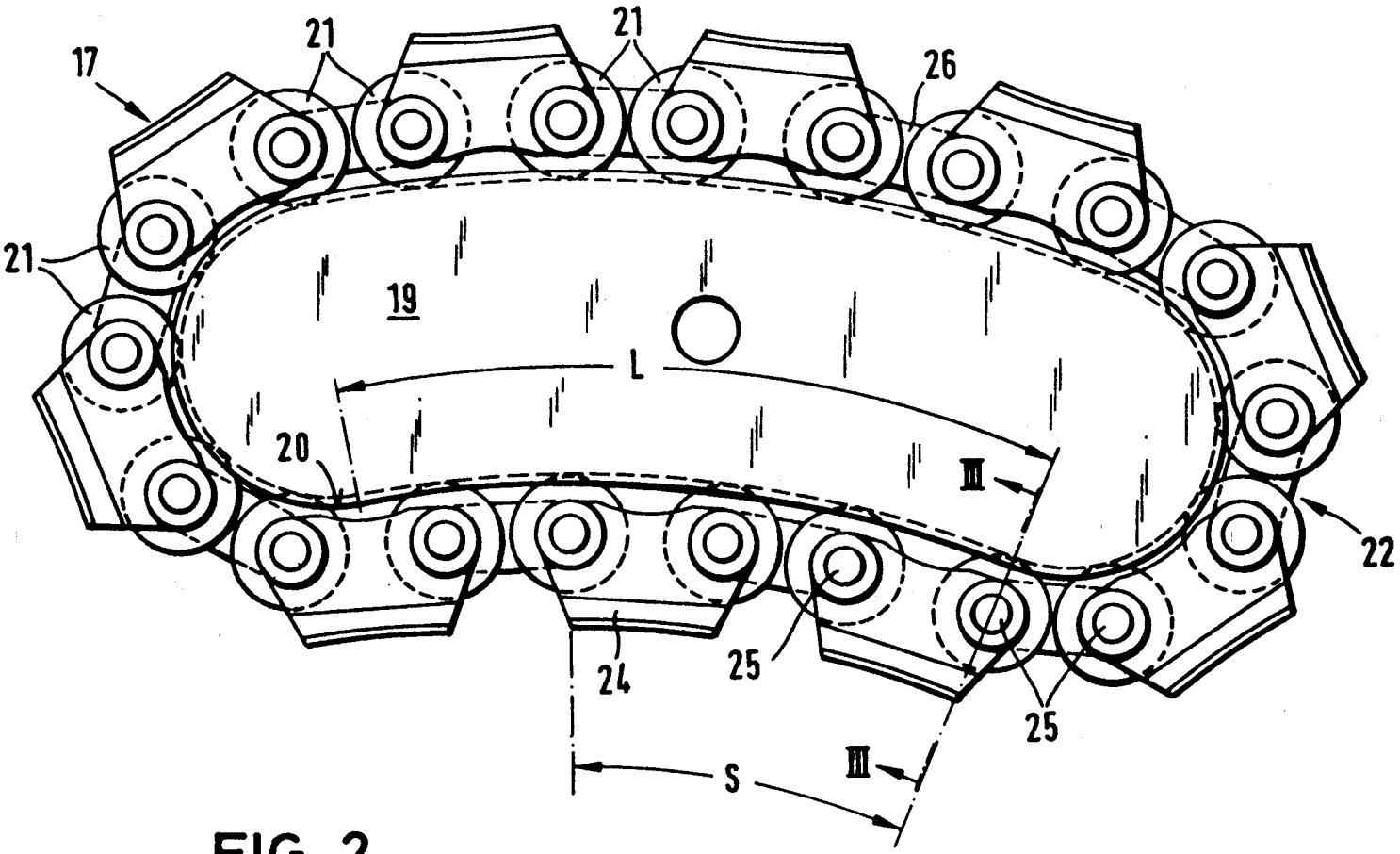
FIG. 2 shows a detail from FIG. 1 on a larger scale, showing a side view of a pressure application unit and circulating chain.

It will be seen from FIG. 2 that the outer parts of at least two, and sometimes three, pressure elements 24 always bear on the line 11. At some stages of operation portions of the third pressure element 24 are running onto or off the line 11. To achieve this, the running surface 20 portion of the pressure application guide unit 19 which extends parallel to the line groove must have a length L at least as great as the distance S occupied by two successive pressure elements 24 in the chain 22 as shown in FIG. 2. Furthermore, the geometric conformation of the application guide unit 19, in particular the smooth curves at its ends, prevents some swinging movements of the pressure elements 24 when they are under pressure and touching the line, and in this way obviates line contacts between the elements 24 and the line 11 which would cause considerable wear.

In one particularly suitable embodiment the running surface 20 extends parallel to the line groove 16 for a length L about three times longer than the length S taken by the pressure elements of the chain. The line is then pressed for a greater length into the groove. The version shown in the drawing does not have these proportions, but the parts correspond in construction.

An alternative arrangement for the pressure rollers 21 is shown in FIG. 4. In this version the pressure rollers are mounted in pairs on either side of the pressure elements 24, outside the flat links 26. As before, the pressure rollers 21 are substantially radially overlapping the pressure elements 24. For this arrangement the pressure application guide unit 19 is provided with two matching running surfaces 20 for the rollers on either side, with guide flanges at the edges and also a central guide flange or ridge 27 between the running surfaces 20. The conformation of the chain track is the same right around the unit 19. With two pressure rollers 21 on each pin 25, each pressure element 24 rests on 4 pressure rollers. In this version the surface area of engagement between the pins 25 and elements 24 is increased, so that the pressure at these links is reduced.

In operation, when the drive pulley 15 rotates, the line 11 and the chain 22 are entrained at the same peripheral speed by frictional interengagement. If desired, an additional positive engagement can be provided by having a type of chain wheel on the drive pulley 15, with pitch corresponding to that of the chain 22. This could be engaged e.g. by the pins 25 on one side only of the chain 22.

The chain 22 is not itself subjected to tensile loads, and therefore runs substantially without wear on the track around the pressure application guide unit 19.

It will be appreciated that many modifications and additions are possible without departing from the scope of the invention as described and claimed. In particular, the word "line" as used herein may denote a rope or cable, e.g. a steel cable, but it may also be a belt such as a knitted synthetic fibre belt which is used as the load-moving line. Such belts can bear with good distribution of load, over a considerable surface area, on a drive pulley e.g. a flat rubberized drive pulley, and can provide advantageous frictional characteristics.

It should also be noted that it may not be necessary to provide a plurality of pressure rollers for each pressure element. A single pressure roller centrally positioned in relation to the pressure element may be sufficient. The important point is to ensure that rocking movements of the pressure elements are minimised when pressure is being applied through them to the line.

The pressure at the application unit 17 may of course also be adjusted e.g. in dependence on the load on the line.

Having thus described the invention, it is claimed:

1. An apparatus for pulling on a line, comprising:

(a) a drive pulley having a periphery and a line groove around said pulley periphery adapted to receive said line;

(b) a pressure application unit mounted adjacent said drive pulley, comprising (i) a guide unit disposed adjacent said pulley periphery of said drive pulley having a running surface facing said pulley periphery and extending in a curve substantially parallel to said pulley periphery;

(ii) an endless chain mounted on said guide unit adapted to run along said running surface, said chain comprising a plurality of pressure elements and a plurality of rotatable pressure rollers supported on said guide unit running surface and spaced from said line, each said pressure element carried on at least two of said pressure rollers and adapted to engage said line;

(c) means for urging said pressure application unit toward said pulley periphery such that said line is engaged by said groove and at least one of said pressure elements.

2. The apparatus of claim 1 wherein said guide unit carries all of said endless chain.

3. The apparatus of claim 1 wherein said guide unit is tiltable relative to the line groove.

4. The apparatus of claim 1 wherein said endless chain comprises a plurality of links and means joining said links together and alternate ones of said plurality of links comprise said pressure elements.

5. The apparatus of claim 4 wherein said plurality of links comprises said pressure elements and flat links disposed alternately.

6. The apparatus of claim 5 wherein said means joining said links comprises transverse pins.

7. The apparatus of claim 1 wherein said endless chain comprises a series of links and transverse pins, said transverse pins joining said links together pivotably.

8. The apparatus of claim 7 wherein said transverse pins serve as axles for said pressure rollers.

9. The apparatus of claim 1 wherein said pressure elements have a longitudinal central plane and said rollers lie in said longitudinal central plane.

10. The apparatus of claim 1 wherein said pressure rollers are provided in pairs, a first pressure roller of each of said pairs being disposed on a first side of said pressure elements and a second pressure roller of each said pair being disposed on a second side of said pressure elements.

11. The apparatus of claim 1 wherein said running surface comprises at least one substantially part-cylindrical surface concentric with the drive pulley.

12. The apparatus of claim 1 wherein said guide unit additionally comprises guide flanges disposed adjacent said running surface adapted to guide said pressure rollers.

13. The apparatus of claim 1 wherein said running surface has a length extending parallel to said pulley periphery accommodating at least two successive pressure elements.

14. The apparatus of claim 1 having a load path run for a through-running line, and a slack path for the slack run of said line, said pressure application unit being positioned to act on line on the drive pulley nearer to the slack run than to the load run.

15. The apparatus of claim 1 wherein the guide unit comprises a single continuous endless track, comprising said running surface, on which said endless chain runs.

16. The apparatus of claim 1 wherein each of said pressure elements has an outwardly facing part having an outwardly-opening groove, said groove extending in the longitudinal direction of said chain and being adapted to engage said line seated in said pulley line groove.

* * * * *